United States Patent [19]

Ohtani et al.

[11] 4,375,378

[45] Mar. 1, 1983

[54] PROCESS FOR PRODUCING SPHEROIDIZED WIRE ROD

[75] Inventors: Saburo Ohtani; Toshimichi Mori; Soichi Izumi, all of Muroranshi, Japan

[73] Assignee: Nippon Steel Corporation, Tokyo, Japan

[21] Appl. No.: 212,223

[22] Filed: Dec. 2, 1980

[30] Foreign Application Priority Data

Dec. 7, 1979 [JP] Japan ..... 54-157997
Sep. 24, 1980 [JP] Japan ..... 55-131579

[51] Int. Cl.[3] ..... C21D 1/76; C21D 8/06

[52] U.S. Cl. ..... 148/12 B; 148/12.3; 148/12.4; 148/134

[58] Field of Search ..... 148/12 B, 16, 16.7, 148/134, 156

[56] References Cited

U.S. PATENT DOCUMENTS 3,666,572 5/1972 Nakagawa et al. ..... 148/12 B
3,711,338 1/1973 Vitelli ..... 148/12 B
3,981,752 9/1976 Kranenberg et al. ..... 148/12 B
4,170,494 10/1979 Fujii et al. ..... 148/12 B
4,242,153 12/1980 Vitelli et al. ..... 148/156

FOREIGN PATENT DOCUMENTS 52-23517 2/1977 Japan ..... 148/12 B
52-80214 7/1977 Japan .

*Primary Examiner*—Peter K. Skiff
*Attorney, Agent, or Firm*—Wenderoth, Lind & Ponack

[57] ABSTRACT

A process for producing a wire rod for cold forging comprising:

rapidly cooling the wire rod after hot rolling so as to give a rapidly cooled structure to the wire rod and to form a predetermined thickness of scale on the wire rod; and subjecting the rapidly cooled wire rod with the scale to spheroidizing annealing in an inert gas containing 0.1% or less moisture.

3 Claims, 4 Drawing Figures

PROCESS FOR PRODUCING SPHEROIDIZED WIRE ROD

BACKGROUND OF THE INVENTION

1. Field of the Invention

The present invention relates to a process for producing with high productivity a steel wire rod with minimal decarburized layer on the surface and having excellent cold forgeability, which process comprises controlling the rolling process of the hot rolled wire rod so as to give a predetermined thickness of scale and a rapidly cooled structure to the wire rod, and spheroidizing annealing this wire rod having the rapidly cooled structure and the predetermined thickness of scale thereon in an inert gas such as $N_2$ gas.

2. Description of Prior Art

Generally, in the cold forging of medium carbon steels or low-alloy steels which are relatively hard and have a low forgeability, the steels are usually subjected to spheroidizing annealing in order to spheroidize the carbides therein and thus to improve their cold forgeability.

In ordinary hot rolled steel wire rods, the carbides constitute a coarse lamellar pearlite structure and, in order to spheroidize these carbides, the steel is usually held at a temperature immediately above the $A_1$ transformation point for several hours, slowly cooled, and then held at a temperature immediately below the $A_1$ transformation point for several hours. The treatment thus requires considerable time.

During this long period, oxidizing gases in spheroidizing annealing atmosphere promote the decarburization of the steel surface. For prevention of such surface decarburization, the annealing is done in a reducing gas atmosphere. However, if scale exists on the steel surface, this scale reacts with the reducing gas to locally generate an oxidizing gas which promotes the surface decarburization. Therefore, it has been necessary to acid-pickle the hot rolled wire rods in order to remove the scale prior to the spheroidizing annealing.

SUMMARY OF THE INVENTION

The present inventors have disclosed in Japanese Patent Application No. Sho 50-155796 (Patent Application Laid-Open No. Sho 52-80214) that the need for the acid-pickling step required prior to annealing in conventional art can be eliminated by annealing a hot rolled wire rod having a satisfactorily thick scale thereon in $N_2$ gas containing a very small amount of moisture.

Through further studies the inventors have now discovered an even further improved method for carrying out spheroidizing annealing of hot rolled wire rod. Namely, they have found that by rapidly cooled the high-temperature wire rod after hot rolling so as to form scale on the rod in an adequate thickness (8μ or more in thickness) and to give the rod a rapidly cooled structure comprised of sorbite and/or bainite, as well as unpreferred but generally unavoidable martensite, it is possible to greatly reduce the time required for spheroidizing annealing and to eliminate the acid-pickling step prior to annealing even when the annealing is done in an inert gas such as $N_2$ containing a relatively large amount, 0.1% or less of moisture.

Hitherto, it has been considered that since scale is an iron oxide, it acts as an oxygen source during annealing and promotes surface decarburization. It does, in fact, react with CO and $H_2$ to produce decarburizing gases such as $CO_2$ and $H_2O$ during annealing in a reducing gas. However, it has been found that when the wire rod having a predetermined thickness of scale, namely a thickness of 8μ or more, is annealed in an inert gas such as $N_2$, Ar or He, the promotion of the decarburization is hindered by the scale because the diffusion of oxygen and other decarburization products is prevented by the relatively thick scale. An excessively thick scale is, however, not preferred since it easily flakes off when the rod is subjected to large impact or strain, thus promoting local surface decarburization during the annealing even when done in $N_2$ gas.

On the other hand, if the wire rod after the hot rolling is cooled to obtain a rapidly cooled structure composed of the sorbite and/or bainite, as well as a small amount of unpreferred but generally unavoidable martensite, the carbides become fine and are relatively uniformly dispersed so that they can be spheroidized in a relatively short time, and hence the long period of spheroidizing annealing required by conventional art can be shortened.

And by this short time spheroidizing annealing in an inert gas containing 0.1% or less moisture the wire rod having 8μ or more in thickness of scale can be restricted within the allowable decarburization depth as specified by the Japanese Industrial Standard G3539.

In this connection, it should be noted that the presence of martensite, though not absolutely intolerable, should be kept as low as possible since martensite tends to increase the hardness of the wire rod following spheroidizing annealing.

The moisture content in the inert gas in which the annealing is done is an important factor affecting surface decarburization. Through their studies concerning this factor, the inventors have found that the desired surface decarburization preventing effect can also be achieved even with a relatively thin scale (3μ or more in thickness), if the annealing is done in an inert gas containing a relatively small amount, 0.05% or less, of moisture.

Therefore, the present invention has two aspects: in one aspect a wire rod of rapidly cooled structure having a relatively thick scale formed thereon is annealed in an inert gas containing a relatively large amount of moisture, and in the other aspect a wire rod of rapidly cooled structure having a relatively thin scale formed thereon is annealed in an inert gas containing a relatively small amount of moisture.

The wire rods to which the present invention is applied are made from ordinary cold forging grades of medium carbon steels and low-alloy steels and have a steel composition falling within the ranges set forth below.

C: 0.20 to 0.60%
Si: not more than 0.50%
Mn: 0.30 to 2.00%
Cr: 0 to 1.5%
Mo: 0 to 0.5%
Balance: Fe and unavoidable impurities The reasons for limiting the contents of the chemical components of the steels to which this invention is applied are now explained in detail.

With carbon contents less than 0.20%, the steel is soft and highly deformable, and therefore, does not require the spheroidizing annealing from the beginning. On the other hand, if the carbon content exceeds 0.60%, the steel is hard and no more deformable and therefore very difficult to be cold forged.

Silicon is added to the steel as a deoxidizing agent, but too much silicon lowers the ductility of the steel, and its content is thus limited to not more than 0.50%.

Manganese must be added in an amount of 0.30% or more for preventing the hot embrittlement of the steel, but an excessive manganese content deteriorates the toughness and deformability of the steel. Therefore, it is desirable to keep the manganese content at 2.0% or less.

Chromium and molybdenum are optionally added to the low-alloy steel for improving its hardenability. However, excessive chromium and molybdenum additions not only increase the production cost, but also lower the forgeability of the steel. Therefore, it is desired to keep the chromium content to 1.5% or lower and the molybdenum content to 0.50% or less.

In the carbon steel of cold forging quality, chromium and molybdenum additions exceeding those unavoidably contained are not necessary.

DETAILED DESCRIPTION OF THE INVENTION

The present invention will be described in detail in connection with its aforesaid two aspects with reference being made to the attached drawings.

The first aspect of this invention will now be described in conjunction with a specific embodiment.

According to the first aspect of the present invention, a wire rod at a temperature at 850° C. or higher after the hot rolling is left to stand for 8 seconds or longer and then rapidly cooled at a cooling rate of 4° C./second or faster to obtain a wire rod having a rapidly cooled structure and having a relatively thick scale formed thereon which is thereafter subjected to spheroidizing annealing in an inert gas such as $N_2$ gas containing a controlled amount of moisture, specifically not more than 0.1% of moisture, to obtain a spheroidized wire rod for cold forging.

The treatment conditions in this embodiment will now be explained in greater detail.

Regarding the temperature of the wire rod after the hot rolling, or the coiling temperature thereof, if the temperature is lower than 850° C., it is difficult to form a scale thick enough to prevent the promotion of decarburization during the subsequent spheroidizing annealing in an inert gas containing a relatively large amount of moisture, and this results in a longer time for slow cooling and lower production efficiency. Therefore, it is preferable that the temperature of the wire rod after the hot rolling or the coiling temperature, be not lower than 850° C. Regarding the standing time of at least 8 seconds preceding the rapidly cooling, this time is necessary for obtaining the desired thickness of scale, and if the time is shorter than 8 seconds, it is difficult to obtain the desired thickness of scale within the coiling temperature range as usually adopted.

The purpose of the rapidly cooling at a cooling rate of at least 4° C./second is to convert the hot rolled structure after the formation of the scale of desired thickness into a rapidly cooled structure composed of sorbite and/or bainite as well as unpreferred but generally unavoidable martensite, in which the carbides are finely and uniformly dispersed, so as to shorten the time required for the subsequent spheroidizing annealing. The desired structure cannot be obtained if the cooling rate is less than 4° C./second.

The reason for specifying the thickness of the scale as being 8μ or more is that when a wire rod having a scale less than 8μ thick is spheroidizing annealed in an inert gas containing less than 0.1% moisture, the decarburizing effect is insufficiently suppressed, often making it impossible to obtain a product meeting JIS standards for decarburization.

Regarding the atmosphere gas in which the spheroidizing annealing is performed, if a reducing gas is used, it reacts with the scale to produce a decarburizing gas, while if an oxidizing gas is used, decarburization and oxidation simultaneously proceed. Therefore, the gas is limited to an inert gas such as $N_2$.

Figure 1:
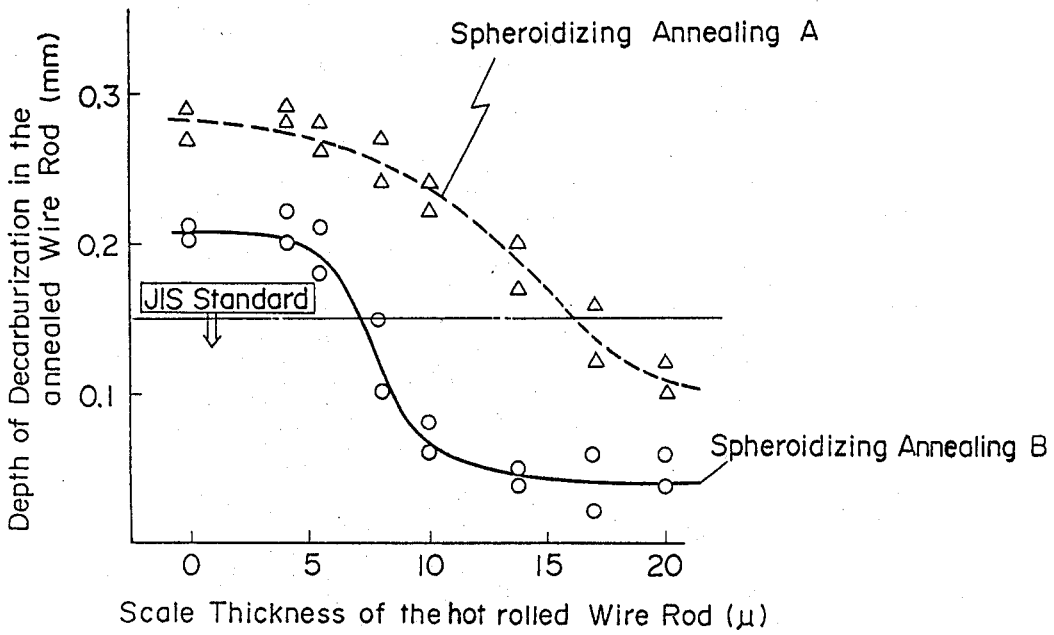
FIG. 1 shows the relation between the decarburization amount and the scale thickness of hot rolled wire rod (JIS SWR CH38K) for cold forging in the spheroidizing annealing of the said wire rod in $N_2$ gas containing 0.1% moisture.

As clearly understood from FIG. 1, if a wire rod having a scale thickness of 8μ or thicker is subjected to the short-period spheroidizing annealing, the decarburization standard specified by JIS can be fully satisified.

The inert gas, such as $N_2$, usually contains a small amount of moisture, and if the moisture content exceeds 0.1%, the decarburization during the short-period spheroidizing annealing of the wire rod of rapidly cooled structure having a scale formed thereon is remarkably promoted, thus failing to meet the decarburization standard specified by JIS and other similar standards. Therefore, the moisture content of the inert gas should not be larger than 0.1% even when the scale is relatively thick.

Next, a preferred embodiment of the second aspect of the present invention will be described in detail.

According to the second aspect of the present invention, the wire rod after hot rolling is rapidly cooled before austenite begins to form at a cooling rate of not less than 4° C./second so as to convert the hot rolled structure into a rapidly cooled structure composed of sorbite and/or bainite as well as a small amount of unpreferred but generally unavoidable martensite, and to form scale on the wire rod in a thickness of not less than 3μ, preferably of between 3 and 10μ. It has been found that if the rapid cooling is stopped at temperatures higher than 600° C., coarse pearlite is likely to appear. Therefore, it is desirable for the rapid cooling to proceed to 600° C. or lower.

As mentioned hereinbefore, if the moisture content of the inert gas in which the spheroidizing annealing is performed is maintained relatively low, the desired decarburization preventing effect can be obtained even with a relatively thin thickness of the scale formed on the wire rod.

Therefore, according to the second aspect of the present invention, the moisture content in the inert gas is maintained at 0.05% or less. However, even with this relatively low moisture content in the inert gas, the thickness of the scale to be formed on the wire rod must be 3μ or thicker, otherwise the desired decarburization preventing effect cannot be obtained. On the other hand, if the scale is excessively thick, the scale easily flakes off under a strong impact or strain. Therefore, although the upper limit of the scale thickness depends on the manner of handling the wire rod, it is most desirable to maintain the scale thickness at about 10μ or less.

Figure 2:
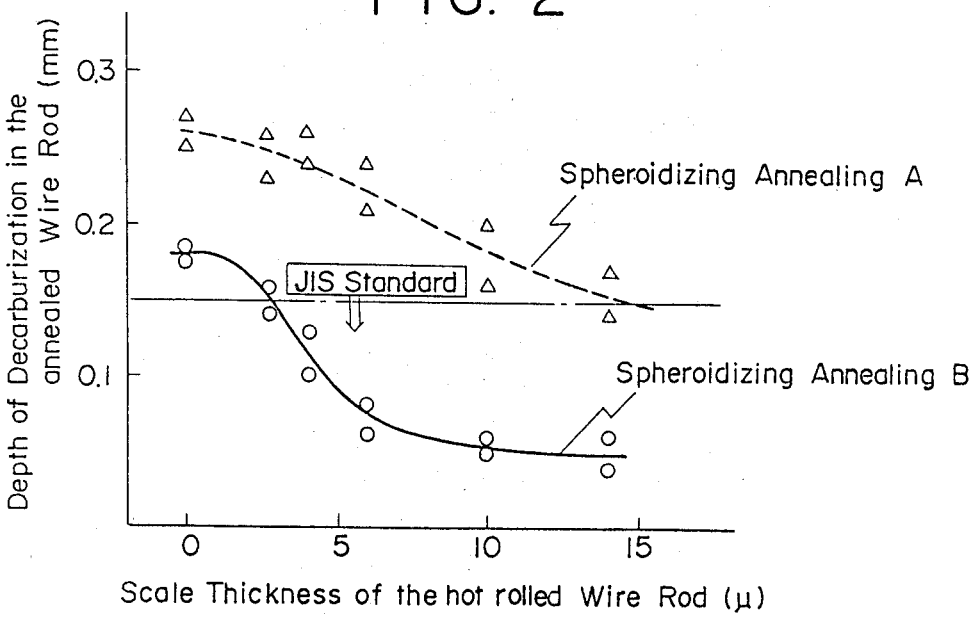
FIG. 2 shows the relation between the decarburization amount and the scale thickness of hot rolled wire rod (JIS SWR CH38K) for cold forging in the spheroidizing annealing of said wire rod in $N_2$ gas containing 0.05% moisture.

As clearly understood from FIG. 2, when the spheroidizing annealing is done in $N_2$ gas containing not more than 0.05% moisture, if the thickness of the scale formed on the wire rod is 3μ or thicker, the standard specified by JIS G3539 can be fully satisfied.

A. Examples according to the first aspect of the present invention.

Carbon steels and low-alloy steels for cold forging having the chemical compositions as shown in Table 1 were prepared and hot rolled under ordinary operation conditions. The rolled sizes and the depths of decarburization after the rolling are also shown in Table 2. After the hot rolling, the resultant wire rods were cooled and subjected to spheroidizing annealing under the conditions shown in Table 2.

In Table 2, Examples No. A-1 to A-4 are within the scope of the present invention. In these Examples, the wire rods were coiled on a moving conveyer at 850° C. or higher, left for the periods of time shown in Table 2, and rapidly cooled by air blowing or hot water. The resultant hot rolled wire rods had 9–14μ thick scale formed thereon and mainly a sorbite and/or bainite structure.

Figure 3:
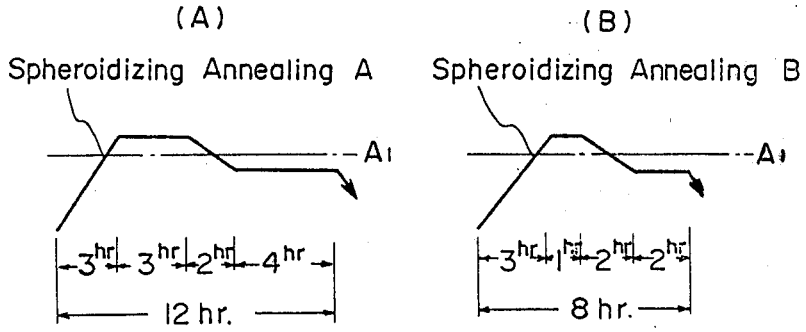
FIG. 3(*a*) shows the heat cycle for the conventional spheroidizing annealing [A], and FIG. 3(*b*) shows the heat cycle for the spheroidizing annealing [B] according to the present invention.

These wire rods were subjected to the spheroidizing annealing [B] as defined by FIG. 3(*b*) in $N_2$ gas containing less than 0.1% moisture. This annealing was shorter by 4 hours than the conventional spheroidizing annealing [A] as shown in FIG. 3(*a*). The decarburization depth of the resultant wire rods fully satisfied the standard of JIS as understood from Table 2 and at the same time, the limit compression ratio (limit compression ratio until the test piece cracks) which represents the cold forgeability of the annealed materials was better than that of the conventional materials.

In Table 2, Examples No. A-5 to A-7 are comparative Examples. In Example No. A-5 the wire rod was rapidly cooled without leaving enough time after the cooling, and then spheroidized in $N_2$ gas. The decarburization preventing effect was not sufficient due to the thin scale, and the wire rod thus failed to meet the standard of JIS. In Example No. A-6, the wire rod was coiled and left to stand at room temperature. The resultant scale was thick enough to prevent decarburization, but the rolled structure was a coarse pearlite structure. Therefore, the cold forgeability was remarkably lowered by a short-period spheroidizing annealing. In Example No. A-7, the wire rod was coiled and then left to stand at room temperature as in Example No. A-6. Although the cold forgeability was restored, the decarburization standard could not be satisfied.

In Examples No. A-8 and No. A-9, which represent the conventional art, the decarburization and the cold forgeability of the annealed wire rods were satisfactory, but it was necessary to descale the wire rods by acid pickling before the annealing and to use an expensive and dangerous reducing gas. Moreover, the spheroidizing annealing required a longer period of time.

B. Examples according to the second aspect of the present invention.

Carbon steels and low-alloy steels for cold forging having the chemical compositions shown in Table 3 were prepared and hot rolled under ordinary operation conditions.

The rolled sizes and the depths of the decarburized layers are shown in Table 3.

After the hot rolling, the resultant wire rods were cooled and subjected to spheroidizing annealing under the conditions shown in Table 4.

In Examples No. B-1 to B-3, the wire rods after hot rolling were immersed in hot water, and in Example No. B-4 the wire rod after hot rolling was cooled by air blowing. The resultant hot rolled wire rods had 4–8μ thick scale formed thereon and had mainly a sorbite and/or bainite structure.

These hot rolled wire rods were subjected to spheroidizing annealing as shown in FIG. 3(*a*) in $N_2$ gas containing not more than 0.05% moisture.

The heating treatment cycle shown in FIG. 3(*b*) shortened the treating time by 4 hours from that required by the conventional spheroidizing annealing shown in FIG. 3(*a*).

The decarburization depth of the wire rods thus obtained fully satisfied the standard of JIS as understood from Table 4, and at the same time, the limit compression ratio which represents the cold forgeability of the annealed materials was better than that of the conventional materials.

In Table 4, Examples No. B-5 to B-7 are comparative Examples. In Example No. B-5, the wire rod was spheroidized in $N_2$ gas containing a relatively large amount of moisture (0.08%). As a consequence, decarburization was promoted, and the wire rod thus failed to meet the decarburization standard specified by JIS. In Example No. B-6, the hot rolled wire rod was left as coiled, thus developed a coarse pearlite structure, and was subjected to spheroidizing annealing as shown in FIG. 3(*b*). As the spheroidizing of the carbides was not sufficient in this Example, the limit compression ratio was considerably low.

In Example No. B-7, the wire rod after the hot rolling was left to develop the coarse pearlite structure, and subjected to the conventional spheroidizing annealing. Although the moisture content in $N_2$ gas was low, the annealing time was long, and the wire rod thus failed to satisfy the decarburization standard of JIS.

In Examples No. B-8 and No. B-9 which represent the conventional art, the decarburization and the cold forgeability of the annealed wire rods were satisfactory, but it was necessary to descale the wire rods by acid-pickling before the annealing and to use an expensive and dangerous reducing gas. Moreover, the spheroidizing annealing required a longer period of time.

As described hereinabove, according to the present invention, it is possible to obtain spheroidized wire rods having satisfactory cold forgeability without substantial surface decarburization by subjecting the hot rolled wire rods having scale thereon to short-period spheroidizing annealing, and the present invention has the following advantages.

(1) It is not necessary to descale the hot rolled wire rods before the spheroidizing annealing.

(2) It is possible to shorten the conventionally required long period for spheroidizing annealing.

(3) Expensive and dangerous reducing gases such as CO and $H_2$ conventionally used as the annealing atmosphere can be replaced by cheap and safe inert gases such as $N_2$.

TABLE 1

| Sample No. | Chemical composition (%) C | Si | Mn | P | S | Cr | Mo | Diameter | Depth of decarburization after rolling |
|---|---|---|---|---|---|---|---|---|---|
| A-a | 0.33 | 0.21 | 0.74 | 0.012 | 0.014 | — | — | 9mm | 0.09mm |
| A-b | 0.38 | 0.18 | 0.42 | 0.022 | 0.017 | — | — | 9mm | 0.02mm |
| A-c | 0.42 | 0.27 | 1.60 | 0.015 | 0.022 | — | — | 18mm | 0.07mm |
| A-d | 0.37 | 0.25 | 0.62 | 0.016 | 0.011 | 1.12 | 0.25 | 14mm | 0.06mm |

TABLE 2

| Example No. | Sample No. | Coiling Temp. | Standing time | Starting temp. of rapid-cooling | Cooling rate | Cooling method | Scale thickness | Main micro-structure | Atmosphere gas | Moisture content of gas | Spheroidizing annealing | Depth of decarburization in annealed material | Limit compression ratio of annealed material |
|---|---|---|---|---|---|---|---|---|---|---|---|---|---|
| | | | | | | This Invention | | | | | | | |
| A-1 | A-a | 900° C. | 15 sec | 830° C. | 7° C./sec | Cooled in air-stream | 9μ | sorbite | $N_2$ | 0.05% | B | 0.10mm | 85% |
| A-2 | A-b | 950° C. | 9 sec | 880° C. | 15° C./sec | Cooled in warm water | 14μ | sorbite | $N_2$ | 0.1% | B | 0.05mm | 84% |
| A-3 | A-c | 880° C. | 25 sec | 820° C. | 8° C./sec | Cooled in warm water | 12μ | bainite | $N_2$ | 0.07% | B | 0.12mm | 82% |
| A-4 | A-d | 920° C. | 12 sec | 870° C. | 5° C./sec | Cooled in air-stream | 10μ | bainite | $N_2$ | 0.04% | B | 0.09mm | 83% |
| | | | | | | Comparative method | | | | | | | |
| A-5 | A-a | 850° C. | 4 sec | 830° C. | 15° C./sec | Cooled in warm water | 4μ | sorbite | $N_2$ | 0.07% | B | 0.26mm | 84% |
| A-6 | A-a | 900° | Left to cool to near room temperature | | | — | 25μ | Coarse pearlite | $N_2$ | 0.05% | B | 0.10mm | 73% |
| A-7 | A-a | 850° C. | Left to cool to near room temperature | | | — | 21μ | Coarse pearlite | $N_2$ | 0.07% | A | 0.21mm | 81% |
| | | | | | | Conventional method | | | | | | | |
| A-8 | A-a | 750° C. | Left to cool to near room temperature | | | — | Descaled by acid-pickling | Coarse pearlite | RX gas | — | A | 0.11mm | 82% |
| A-9 | A-d | 830° C. | Left to cool to near room temperature | | | — | Descaled by acid-pickling | Coarse pearlite | RX gas | — | A | 0.08mm | 80% |

Table 3

| Sample No. | Chemical composition (%) C | Si | Mn | P | S | Cr | No | Diameter | Depth of decarburization after rolling |
|---|---|---|---|---|---|---|---|---|---|
| B-a | 0.31 | 0.25 | 0.68 | 0.014 | 0.017 | — | — | 7mm | 0.02mm |
| B-b | 0.38 | 0.21 | 0.82 | 0.018 | 0.012 | — | — | 9mm | 0.04mm |
| B-c | 0.41 | 0.24 | 1.53 | 0.021 | 0.015 | — | — | 18mm | 0.03mm |
| B-d | 0.37 | 0.25 | 0.62 | 0.016 | 0.011 | 1.12 | 0.25 | 10mm | 0.04mm |

TABLE 4

| Example No. | Sample No. | Rate of cooling after hot rolling | Cooling method | Main micro-structure | Scale thickness | Spheroidizing annealing | Atmosphere gas | Moisture content of gas | Depth of decarburization in annealed material | Limit compression ratio of annealed material |
|---|---|---|---|---|---|---|---|---|---|---|
| | | | | | This Invention | | | | | |
| B-1 | B-a | 15° C./sec | Cooled in warm water | sorbite | 4μ | B | $N_2$ | 0.01% | 0.10mm | 85% |
| B-2 | B-b | 12° C./sec | Cooled in warm water | sorbite | 6μ | B | $N_2$ | 0.02% | 0.08mm | 85% |
| B-3 | B-c | 7° C./sec | Cooled in warm water | bainite | 8μ | B | $N_2$ | 0.04% | 0.12mm | 83% |
| B-4 | B-d | 5° C./sec | Cooled in air-stream | bainite | 5μ | B | Ar | 0.02% | 0.07mm | 82% |
| | | | | | Comparative method | | | | | |

TABLE 4-continued

| Example No. | Sample No. | Rate of cooling after hot rolling | Cooling method | Main micro-structure | Scale thickness | Spheroidizing annealing | Atmosphere gas | Moisture content of gas | Depth of decarbur-ization in annealed material | Limit compression ratio of annealed material |
|---|---|---|---|---|---|---|---|---|---|---|
| B-5 | B-b | 10° C./sec | Cooled in warm water | sorbite | 5μ | B | $N_2$ | 0.08% | 0.18mm | 84% |
| B-6 | B-b | 0.1° C./sec | Left standing | Coarse pearlite | 18μ | B | $N_2$ | 0.03% | 0.10mm | 71% |
| B-7 | B-b | 0.1° C./sec | Left standing | Coarse pearlite | 18μ | A | $N_2$ | 0.04% | 0.19mm | 80% |
| | | | | | Conventional method | | | | | |
| B-8 | B-b | 0.1° C./sec | Left standing | Coarse pearlite | Descaled by acid-pickling | A | RX | — | 0.11mm | 83% |
| B-9 | B-d | 0.2° C./sec | Left standing | Coarse pearlite | Descaled by acid-pickling | A | RX | — | 0.09mm | 81% |

What is claimed is:

1. A process for producing a cold forging steel wire rod having a reduced decarburized layer thickness on the surface and excellent cold forgeability consisting essentially of:

hot rolling a steel wire rod and permitting the hot rolled wire rod to stand for at least 8 seconds to form a layer of scale having a thickness of at least 8 microns on the surface of the rod;

quenching the hot rolled wire rod at a cooling rate of at least 4° C./sec. to produce a rapidly cooled structure composed of sorbite and/or bainite as well as a small amount of incidental martensite; and spheroidizing annealing said rod in an inert gas having a moisture content of about 0.04 to about 0.1%.

2. A process according to claim 1 in which the wire rod contains:

C: 0.20 to 0.60%
Si: 0.50% or less
Mn: 0.30 to 2.00%
Cr: 0 to 1.5%
Mo: 0 to 0.50%
Balance: Fe and unavoidable impurities.

3. A process according to claim 1 in which the thickness of decarburization layer formed on the steel wire rod is below the JIS Standard indicated in FIG. 1.

* * * * *